US006609623B2

(12) United States Patent
Chou

(10) Patent No.: US 6,609,623 B2
(45) Date of Patent: Aug. 26, 2003

(54) STORAGE BOX

(75) Inventor: Hsin Hung Chou, Taipei (TW)

(73) Assignees: Hsin-Hung Chou, Taipei (TW); Cheng Fong Plastics Co., Ltd., Taipei Hsien (TW)

( * ) Notice: Subject to any disclaimer, the term of this patent is extended or adjusted under 35 U.S.C. 154(b) by 0 days.

(21) Appl. No.: 09/970,783

(22) Filed: Oct. 5, 2001

(65) Prior Publication Data

US 2003/0066833 A1 Apr. 10, 2003

(51) Int. Cl.[7] ..... B65D 43/16

(52) U.S. Cl. ..... 220/4.23; 220/4.24; 220/835; 220/839

(58) Field of Search ..... 220/4.21, 4.22, 220/4.23, 324, 793, 833, 835, 796, 805, 839, 4.24, 834, 837; 215/305; D7/538, 540, 542; D9/425, 431

(56) References Cited

U.S. PATENT DOCUMENTS 5,377,860 A * 1/1995 Littlejohn et al. ..... 220/4.21
5,860,549 A * 1/1999 Allers et al. ..... 220/23.87
5,979,687 A * 11/1999 Hayes et al. ..... 220/4.23
6,047,819 A * 4/2000 Borst et al. ..... 206/232

FOREIGN PATENT DOCUMENTS

JP 8-72909 * 3/1996

* cited by examiner

*Primary Examiner*—Lee Young
*Assistant Examiner*—Joseph C. Merek
(74) *Attorney, Agent, or Firm*—Bacon & Thomas

(57) ABSTRACT

A storage box includes an upper cover integrally connected at a rear edge to a lower cover. The upper and the lower covers are provided along their peripheral edges with a recess and a flange, respectively, that engage with each other when the upper cover is closed onto the lower cover. Upper and lower marginal belts surrounding the recess and the flange, respectively, are provided with projections, so that a gap always exists between the two marginal belts to facilitate easy opening of the upper cover relative to the lower cover. The recess and the flange are provided with tongues that abut on each other to lock the upper cover to the lower cover but allow a fit clearance between the recess and the flange, so that the upper and the lower covers would not become stuck at the recess and the flange.

4 Claims, 3 Drawing Sheets

STORAGE BOX

BACKGROUND OF THE INVENTION

1. Field of the Invention

The present invention relates to a storage box, and more particularly to a storage box having a fastening mechanism that enables easy and quick opening and re-closing of the storage box.

2. Description of the Prior Art

Various types of packaging products, such as food wraps, storage boxes, storage bags, etc., that are made of materials suitable for using with microwaves have been developed for use in a wide range of fields. Among these packaging products, the storage boxes for containing instant foods are particularly welcome due to their ability of keeping food fresh for a prolonged time without leaving any bad plastic smell. These storage boxes also have the advantages of easy to clean, resistant to high and low temperatures, not easily corroded by acids and alkalis, and particularly, useable with microwaves.

FIG. 1 shows a conventional storage box A1 widely used by instant food stores to hold hamburgers, fried chickens, etc. As shown, the conventional storage box A1 typically includes an upper cover A2 and a lower cover A3 integrally connected at a rear edge of the box. In early stage, marginal belts A21, A31 of the upper and the lower covers, respectively, are directly stapled together to close the upper cover A2 to the lower cover A3. This manner of closing the storage box A1 is bothersome because a stapler is needed to close the storage box A1 and the staples must be removed before the storage box A1 could be opened. And, once the storage box A1 is opened, it could not be closed again without a stapler.

To solve the above-mentioned problems, a fastening mechanism has been developed for the conventional storage box A1. As shown in FIG. 1, the fastening mechanism includes two fastening portions A4 correspondingly provided at proper positions on the marginal belts A21, A31 of the upper and the lower covers A2, A3, respectively. Please refer to FIG. 2. The two fastening portions A4 are integral parts of the marginal belts A21, A31 of the upper and the lower covers A2, A3, respectively, and are so shaped that the lower fastening portion A4 is tightly fitted into the upper fastening portion A4 when the upper cover A2 is fully closed onto the lower cover A3. That is, the two fastening portions A4 are tightly joined together in a mortise-and-tongue relation. This type of mortise-and-tongue joint has the following disadvantages:

1. For the two fastening portions A4 to provide a good fastening effect, the upper fastening portion A4 provides a mortise that is slightly smaller than a tongue provided by the lower fastening portion A4, so that the mortise and the tongue could firmly engage with each other. Thus, there is not any fit clearance between the two fastening portions A4. In this tight fit relation, the lower fastening portion A4 tends to become stuck in the upper fastening portion A4. When a force that is applied to separate the two tightly joined fastening portions A4 is too strong, the fastening portions A4 would inevitably become deformed and lose their fastening function, preventing the upper and the lower covers A2, A3 from closing again via the fastening portions A4. In a worse condition, the entire storage box A1 is deformed, broken or careless turned over.
2. Since the upper and the lower marginal belts A21, A31 are designed to completely contact with one another when the upper cover A2 is fully closed onto the lower cover A3, and there is a contact stress produced at the time the storage box A1 is closed, a user encounters increased difficulties in separating the upper marginal belt A21 from the lower marginal belt A31. Some users might try to open the storage box A1 by extending fingernails into the tight joint between the upper and the lower marginal belts and unfortunately get injured at the fingers.

It is therefore tried by the inventor to develop a storage box that has a fastening mechanism enabling the storage box to be easily opened and re-closed without becoming damaged.

SUMMARY OF THE INVENTION

A primary object of the present invention is to provide a storage box that eliminates the problem of tightly contacted upper and lower marginal belts and injured fingernails attempting to separating such marginal belts from one another.

Another object of the present invention is to provide a storage box that omits the conventional tight-fit fastening portions to avoid the problem of deformed storage box due to an overlarge force applied to open the fastening portions.

A further object of the present invention is to provide a storage box having retreated portions for a user to stably hold thereat to close or open the storage box without causing a turned-over box.

A still further object of the present invention is to provide a storage box having expanded antislip areas, at where a user may apply forces to instantly and stably close or open the storage box.

To achieve the above and other objects, the storage box of the present invention mainly includes an upper cover integrally connected at a rear edge to a lower cover. The upper and the lower covers are provided along their peripheral edges with a recess and a flange, respectively, that engage with each other when the upper cover is closed onto the lower cover.

Upper and lower marginal belts surrounding the recess and the flange, respectively, are provided at front corners with coarse areas, on which projections are provided so that a gap always exists between the two marginal belts to facilitate easy opening of the upper cover relative to the lower cover. The coarse areas provide good antislip effect when a user's fingers contact with them.

The recess and the flange are provided with tongues. The tongue on the recess goes to abut a lower side of the tongue on the flange when the upper cover is fully closed onto the lower cover, and thereby locks the upper cover to the lower cover. The tongues allow a fit clearance between the recess and the flange, so that the upper and the lower covers would not become stuck at the recess and the flange when they are closed to each other.

The upper cover is provided at two front corners with two retreated portions, so that two expanded areas are formed at the two front corners immediately in front of the two retreated portions to provide good places at where the user may conveniently apply forces to close the upper and the lower covers 2, 3 together. Antislip strips are provided on the expanded areas to ensure stable contact of the user's fingers with the expanded areas to apply the forces. By applying forces at the expanded areas, the tongues on the recess and the flange could be quickly brought into place to lock the two covers together.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 3:
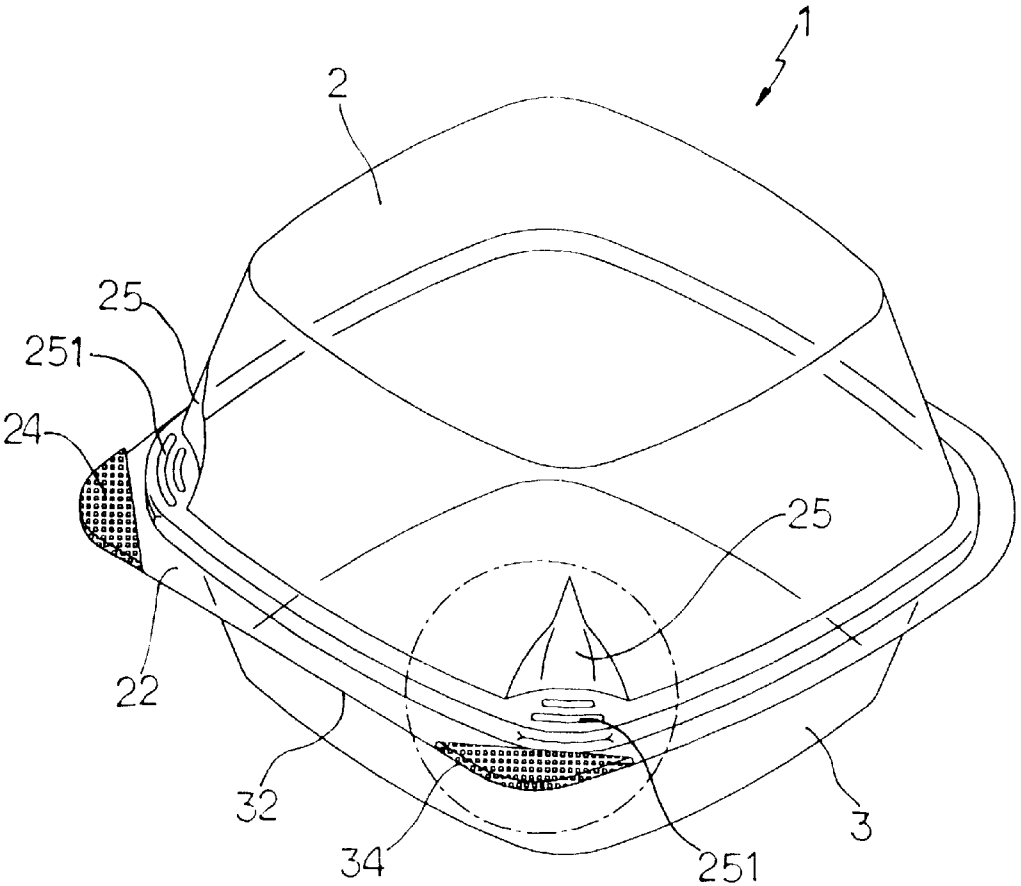
FIG. 3 is a perspective view of a storage box according to the present invention in a closed state.
Figure 4:
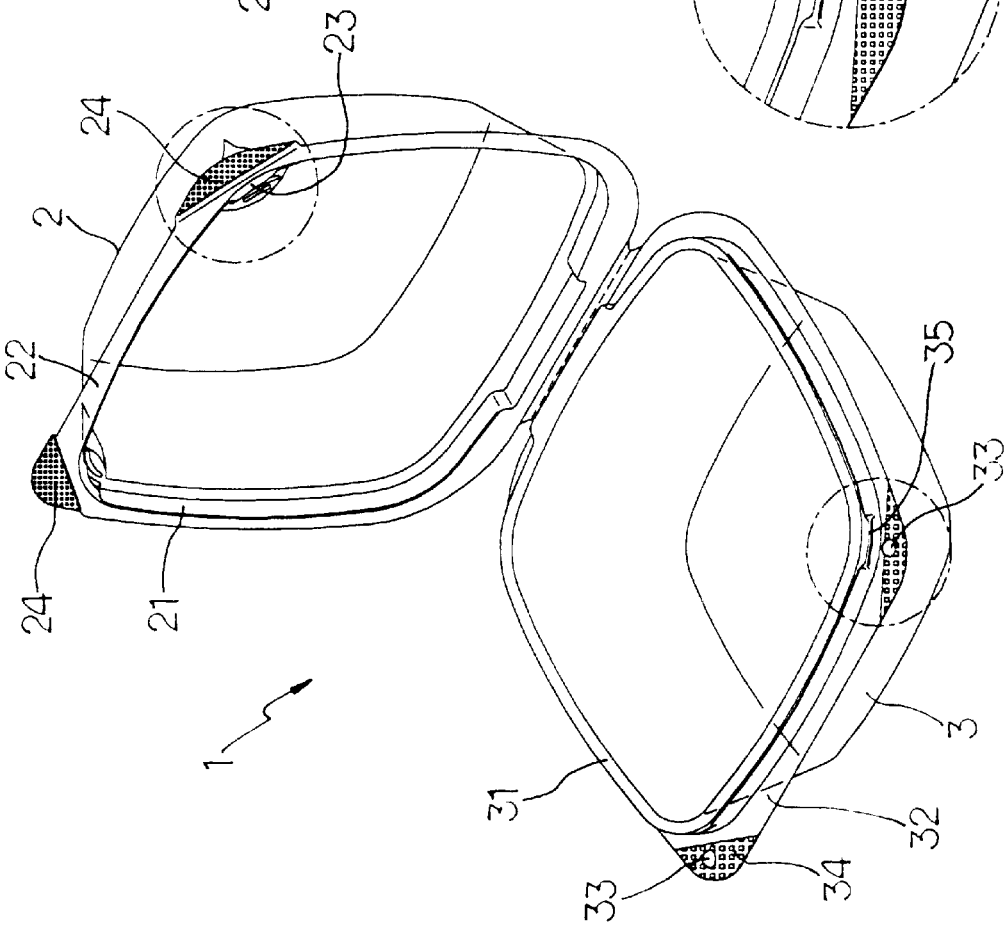
FIG. 4 is a perspective view of the storage box of FIG. 3 in an open state.

Please refer to FIG. 3 in which a storage box 1 according to the present invention is shown. The storage box 1 includes an upper cover 2 and a lower cover 3 that are integrally connected to each other at a rear edge thereof, such that the upper cover 2 could be opened and closed relative to the lower cover 3. FIG. 4 shows the storage box 1 of FIG. 3 with the upper cover 2 in an opened position. As can be clearly seen from FIG. 4, the upper and the lower covers 2, 3 are provided along their peripheral edges with a recess 21 and a flange 31, respectively, such that the flange 31 is fitly located in the recess 21 when the upper cover 2 is closed onto the lower cover 3. The peripheral edges of the upper and the lower covers 2, 3 surrounding the recess 21 and the flange 31 extend horizontally by a predetermined distance to form upper and lower marginal belts 22, 32, respectively. Portions of the lower marginal belt 32 at two front corners of the lower cover 3 are provided with coarse surfaces 34, and an upward projection 33 is formed in each of the coarse surfaces 34. The projection 33 may be of any shape. Meanwhile, portions of the upper marginal belt 22 at two front corners of the upper cover 2 are also provided with coarse surfaces 24 corresponding to the coarse surfaces 34.

Figure 1:
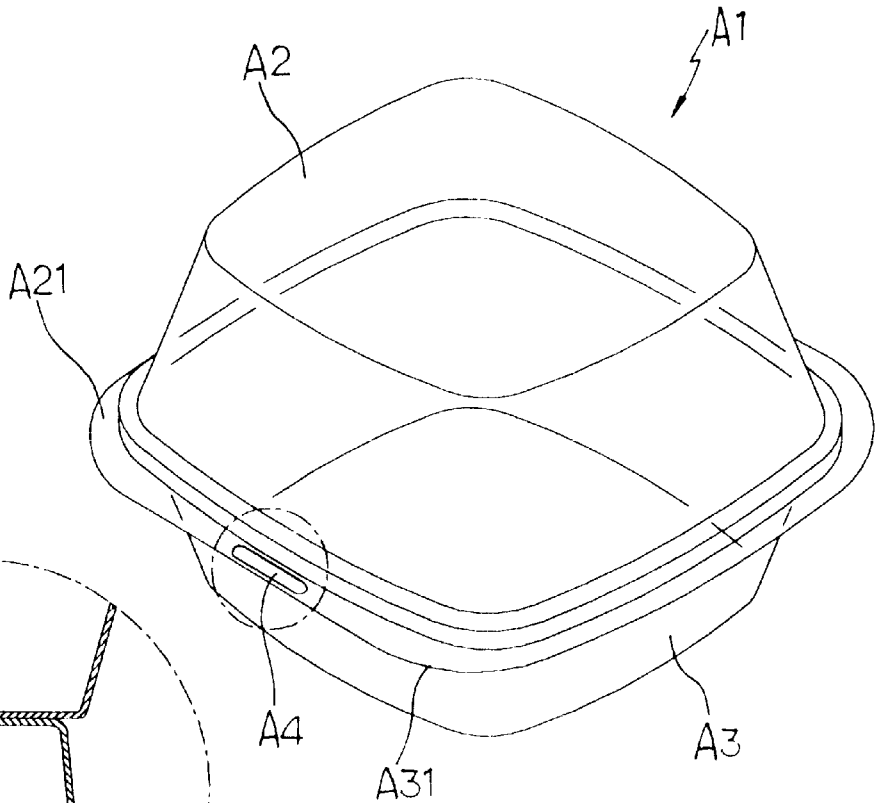
FIG. 1 is a perspective view of a conventional storage box.
Figure 2:
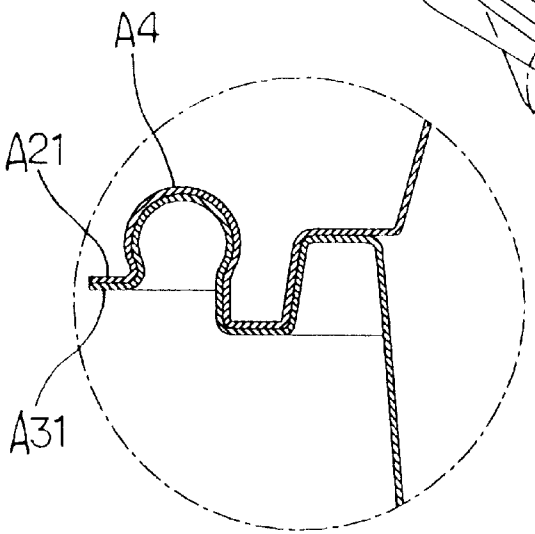
FIG. 2 is a fragmentary and enlarged sectional view of fastening portions on the conventional storage box of FIG. 1.
Figure 7:
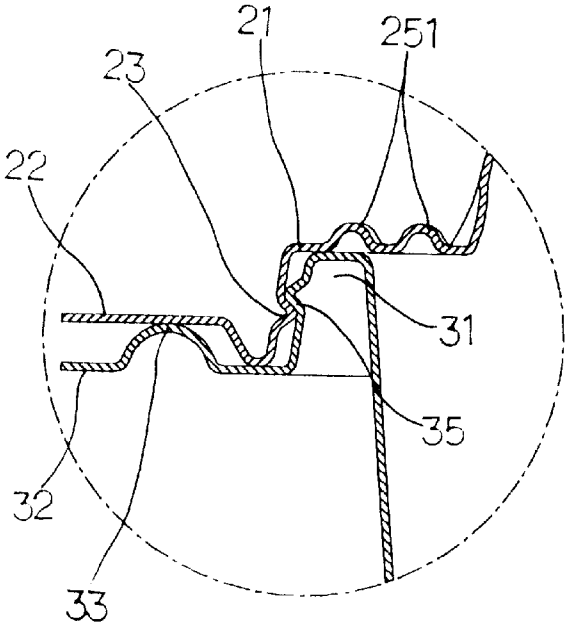
FIG. 7 is a fragmentary and enlarged sectional view of the circled area of FIG. 3.
Figure 6:
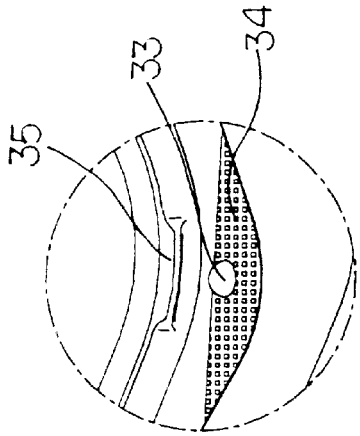
FIG. 6 is a fragmentary and enlarged view of the circled area of FIG. 4.

As can be seen from FIGS. 6 and 7, the provision of the projections 33 allows a gap between the upper and the lower marginal belts 22, 32 of the upper and the lower covers 2, 3, respectively, to facilitate separation of the upper cover 2 from the lower cover 3. The coarse surfaces 24, 34 at the front corners of the upper and the lower covers 2, 3, respectively, effectively prevent a user's fingers from skidding off the marginal belts 22, 32 when the user tries to open the storage box 1. Of course, the projections may be otherwise provided at a lower side of the upper marginal belt 22 at the two front corners to provide the same separating gap between the upper and the lower covers 2, 3.

Figure 5:
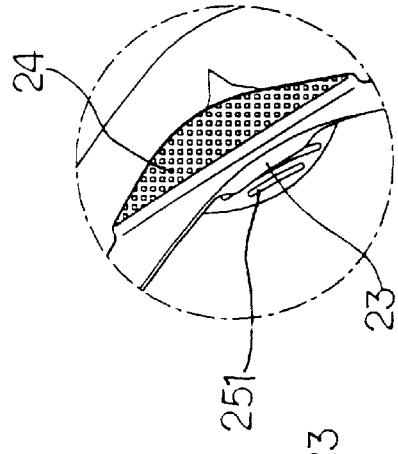
FIG. 5 is a fragmentary and enlarged view of the circled area of FIG. 4.

Please refer to FIGS. 4, 5 and 7. The upper cover 2 is provided at an inner side of the recess 21 with a first tongue 23, and the lower cover 3 is provided at an outer side of the flange 31 with a second tongue 35, such that the first tongue 23 goes to a position below the second tongue 35 and fitly abuts against the latter when the upper cover 2 is fully closed onto the lower cover 3. Briefly speaking, the first tongue 23 abuts on a lower side of the second tongue 35 to lock the upper cover 2 to the lower cover 3 at the recess 21 and the flange 31, as can be best seen in FIG. 7.

Please refer back to FIG. 3. The upper cover 2 is provided at two front corners with two retreated portions 25, so that two expanded areas are formed at the two front corners immediately in front of the two retreated portions 25. The expanded areas provide good places at where the user may conveniently apply forces with, for example, a thumb and an index finger to close the upper and the lower covers 2, 3 together. Antislip strips 251 are provided on the expanded areas to ensure stable contact of the user's fingers with the expanded areas to apply the forces. The first and the second tongues 23, 35 may be best effectively brought to lock with each other by applying forces on the expanded areas.

As can be seen in FIG. 7, the upper and the lower covers 2, 3 are closed through abutting of the first tongue 23 on the lower side of the second tongue 35. Therefore, a slightly increased fit clearance is allowed between the recess 21 and the flange 31 to replace the tight-fit relation that is adopted for the fastening portions A4 of the conventional storage box A1. With the slightly increased fit clearance between the recess 21 and the flange 31, the problem of stuck and deformed peripheral edges of the upper and the lower covers of the storage box could be avoided.

What is claimed is:

1. A storage box, comprising an upper and a lower cover integrally connected to one another at a rear edge of said storage box, so that said upper cover is openable and closable relative to said lower cover; said upper and said lower covers being provided along their peripheral edges with a recess and a flange, respectively, such that said flange is fitly located in said recess when said upper cover is closed onto said lower cover; said peripheral edges of said upper and said lower covers surrounding said recess and said flange extending horizontally by a predetermined distance to form upper and lower marginal belts, respectively;

portions of said lower marginal belt at two front corners of said lower cover being provided with coarse surfaces, and portions of said upper marginal belt at two front corners of said upper cover also being provided with coarse surfaces corresponding to said coarse surfaces on said lower marginal belt;

said upper cover being provided at an inner side of said recess with a first tongue, and said lower cover being provided at an outer side of said flange with a second tongue, such that said first tongue goes to a position below said second tongue and fitly abuts against the latter when said upper cover is fully closed onto said lower cover, and thereby locks said upper cover to said lower cover at said first and said second tongues; and said upper cover being provided at two front corners with two retreated portions, so that two expanded areas are formed at said two front corners immediately in front of said two retreated portions to facilitate applying of forces by a user with fingers on said expanded areas to close said upper cover onto said lower cover, and antislip strips being provided on said expanded areas to ensure stable contact of the user's fingers with said expanded areas.

2. The storage box as claimed in claim 1, wherein said coarse surfaces at two front corners of said lower marginal belt are provided with an upward projection each, so that a gap is allowed between said upper and said lower marginal belts to facilitate easy separation of said two marginal belts from one anther, and wherein said projections may be of any shape.

3. The storage box as claimed in claim 1, wherein said coarse surfaces at two front corners of said upper marginal belt are provided with a downward projection each, so that a gap is allowed between said upper and said lower marginal belts to facilitate easy separation of said two marginal belts from one anther, and wherein said projections may be of any shape.

4. The storage box as claimed in claim 1, wherein said recess in said upper cover and said flange in said lower cover, respectively, have a fit clearance existed between them to avoid said storage box from becoming stuck at peripheral edges of said upper and said lower covers, and from becoming deformed due to a strong force applied by the user to separate said stuck peripheral edges.

* * * * *